United States Patent [19]

LaBounty

[11] Patent Number: 4,703,968

[45] Date of Patent: Nov. 3, 1987

[54] GRAPPLE FOR ORIENTING TRACK RAILS

[76] Inventor: Roy E. LaBounty, 1607 Eighth Ave., Two Harbors, Minn. 55616

[21] Appl. No.: 897,315

[22] Filed: Aug. 18, 1986

[51] Int. Cl.[4] ..... B66C 1/64

[52] U.S. Cl. ..... 294/88; 294/86.41; 294/106; 294/902

[58] Field of Search ..... 294/68.23, 85, 86.4, 294/86.41, 88, 104–107, 902; 37/183 R–188, DIG. 12; 269/257, 266, 270; 414/729, 739, 740, 759, 760, 780, 784

[56] References Cited

U.S. PATENT DOCUMENTS

| | | | |
|---|---|---|---|
| 451,090 | 4/1891 | Walter | 294/106 |
| 2,415,898 | 2/1947 | Meadows | 294/106 |
| 2,509,484 | 5/1950 | Curley | 294/106 |
| 2,639,937 | 5/1953 | Billings | 294/107 X |
| 3,177,029 | 4/1965 | Larson | 294/106 X |
| 3,201,167 | 8/1965 | Wampler | 294/106 X |
| 3,651,966 | 3/1972 | Willett | 294/86.41 X |
| 4,012,069 | 3/1977 | Carson | 294/106 X |

*Primary Examiner*—Johnny D. Cherry
*Attorney, Agent, or Firm*—Palmatier & Sjoquist

[57] ABSTRACT

The present invention is a grapple for orienting track rails. The grapple includes a front tine and rear tine arcuate in shape and pivotally secured to a bottom end of a frame and depending therefrom to tip ends. Each tine defines an inner concave surface, and the tines are mounted to the frames so that the concave surfaces face towards each other. The front tine includes a knob portion integral with its tip end that extends outwardly from its inner concave surface towards the inner concave surface of the back tine. The tines are operated by a pair of hydraulic cylinders, and each tine includes a plurality of gear teeth extending from the end thereof that is secured to the frame. The gear teeth are enmeshed and provide for coincidental opening and closing of the tines by operation of the hydraulic cylinders. The knob portion of the front tine provides for cooperation with the ball portion of the railroad rail for orienting the rail into a desired upright position.

5 Claims, 7 Drawing Figures

GRAPPLE FOR ORIENTING TRACK RAILS

BACKGROUND OF THE INVENTION

1. Field of the Invention

The invention relates to attachments for the boom structure and hydraulic system for a hydraulic excavator or the like, and in particular to such attachments that are used for handling railroad rails.

2. Background

Many miles of railroad tracks are scrapped each year as the result of removal of obsolete lines or as the result of replacement of worn track. The old track rails can then be reprocessed for their scrap value. Essentially, the long rail sections must be broken into smaller pieces so that they can be more easily handled and shipped to a processing center where they can be melted down and reused. The rails can be segmented as they are removed from the track bed, or the long sections thereof can be transported to a scrap yard where they can be broken down.

As seen in Applicant's U.S. Pat. No. 4,522,323 issued June 11, 1985, there is disclosed a rail breaking machine that can be used either to break the rail as it is being removed from the track bed, or can be used as a piece of stationary equipment to break long sections of rails in a scrap yard. In the former case, the rails are automatically fed into the rail breaking device in the proper orientation, namely, as the rail normally sits on the rail bed with the flange portion down and the ball portion up. However, in the latter case, as the rails are often lying in a variety of random positions in a scrap yard, they must first be oriented into the proper upright position before being fed into the rail splitting machine. The weight of the long rail sections requires that they be lifted by a suitable piece of heavy equipment such as a backhoe, having a grapple attached to the boom thereof. However, prior art grapples cannot provide the degree of control that is needed to easily manipulate the rail into the position necessary for the proper operation of the machine. Thus, a great deal of time and energy can be spent in orienting the rail, thereby greatly reducing the profitability of reprocessing steel rails.

3. Summary of the Invention

An object of the present invention is to provide a grapple that can easily and efficiently orient track rails into a desired position.

Another object of the present invention is to provide such a rail orienting grapple that is portable through attachment to the boom structure and hydraulic system of a hydraulic excavating machine such as a backhoe.

A feature of the present invention is a grapple with cooperating front and back tines, the front tine being arcuate in shape, and pivotally secured to a lower portion of the frame and depending therefrom to a tip end. On the working side of the front tine is a knob projecting slightly toward the back tine.

Another feature of the present invention is a rigid frame incorporating a rotary mounting. The rotary mounting provides for rotation of the frame, about a central axis thereof, through an arc of 360°. The rotary mounting includes attachment means integral therewith for providing releasable securing of the frame to the boom structure and hydraulic system of the excavator.

The front and rear tines each include gear teeth integral with each of the ends thereof that are secured to the frame. The gear teeth of the tines are enmeshed so that the tines, when operated by each respective hydraulic cylinder, swing with respect to each other in a coincidental manner.

The present invention operates to pick up railroad rail and orient them into upright position so that they may be properly fed into a stationary rail breaking machine. Such operation can be best understood in the typical situation wherein a rail is lying upon its side in a horizontal position with a portion of the ball and flange thereof contacting the ground. The rotary mounting can be used, if needed, to orient the frame so that the front tine, and thus the knob thereof, confronts the ball or head of the rail, and the back tine therefore confronts the flange end of the rail.

Operation of the hydraulic cylinders attached to the tines causes them to close together and interleave. In so doing, the rail will be picked up between the tines in a manner wherein the flange portion of the rail will be oriented such that the bottom surface thereof will be substantially parallel with that portion of the concave outer surface of the back tine that it is in contact with. If the tines are then allowed to open slowly, the flange portion of the rail will slide, by the force of gravity, along the exterior convex surface of the back tine such that the lower end of the flange will be the first portion of the rail to protrude between the ends of the tines as they begin to separate. The ball or head of the rail will then be caught or held by the knob portion of the front tine. As a result thereof, if the rail is positioned just above the ground, the flange will first contact the ground, thus, as the ball of the rail is held by the knob of the front tine, the rail can then be urged into an upright position with the flange contacting the ground, by suitable operation of the tines and/or the boom of the excavator.

In the event the bottom flange of the rail confronts the front tine and the knob when the rail is initially being picked up, the rail may be turned over by simply closing the tines under the rail, whereupon the rail will be tipped upward so that the ball or head depends from the bottom flange. Then the grapple tines may be opened slightly, whereupon the knob on the front tine will catch the flange of the rail as the rail is being lowered due to the opening of the tines. The continued opening of the grapple will cause the rail to be laid upon the ground with the head or ball disposed adjacent the front tine and the bottom flange disposed adjacent the back tine. After the rail has been reoriented in this way, the rail may be picked up again and reoriented as described above.

The rail as it sits in this horizontal upright position on the ground can then be easily grasped, along the web portion thereof between the knob and flange by the tines, and lifted, and then fed into the stationary rail breaking machine.

It can be appreciated that the enmeshed gear teeth of the tines, in cooperation with the hydraulic cylinders, serve to prevent any undesired movement of the tines as the rail is being manipulated, which movement can reduce the degree of control of the rail, and which movement could result in dropping of the rail.

It is therefore a major advantage of the present invention that one of the tines includes a knob portion for cooperating with the ball portion of a rail to allow for quick and easy orienting thereof.

It is also a major advantage of the present invention that it is portable through releasable attachment to the boom structure and hydraulic system of an excavator so that it can be easily moved within a scrap yard to various locations where it may be needed, and in fact, can easily be transported from one yard to another.

DETAILED DESCRIPTION OF A PREFERRED EMBODIMENT

Figure 1:
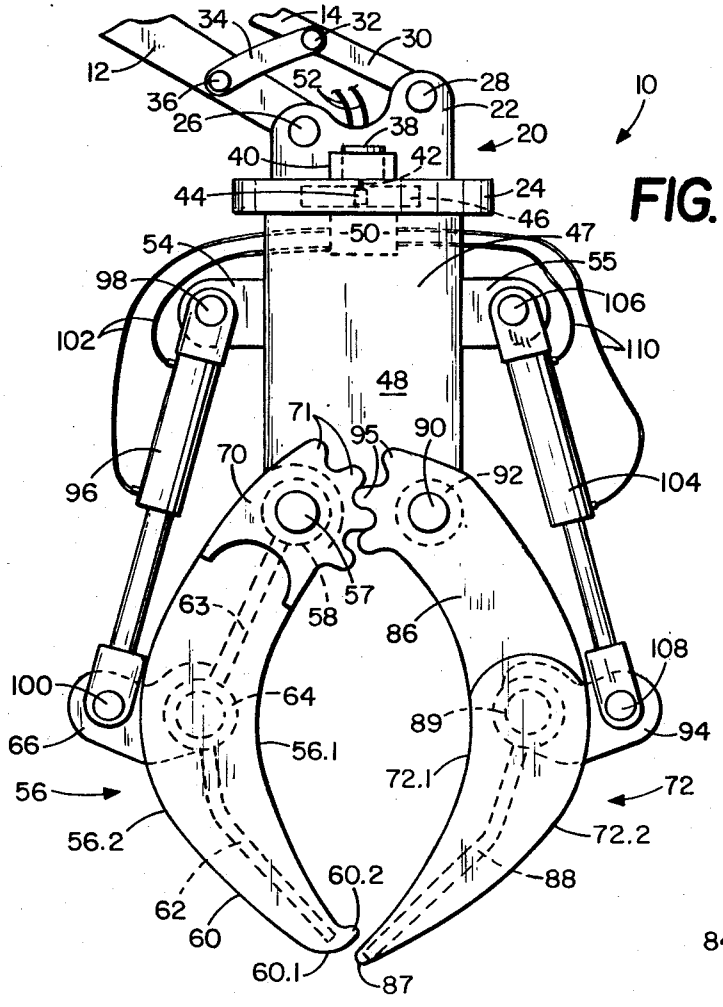
FIG. 1 shows an enlarged front elevation view of the rail grapple.

One form of the invention is illustrated in the drawings and is described herein. The rail grapple apparatus of the present invention is indicated in general by number 10, and, as seen in FIG. 1, is shown connected to a boom or boom structure 12 and a hydraulic cylinder 14 of a hydraulic excavator, not shown, such as a backhoe.

Rail grapple 10 includes a rotational mounting generally designated 20. A pair of rigid parallel mounting ears 22 extend from and are integral with a turntable bearing plate 24, of rotational mounting 20. Mounting ears 22 include apertures therein for receiving mounting pins 26 and 28. Pin 26 provides for pivotal mounting of boom 12 to mounting ears 22. Pin 28 provides for pivotal securing of linkage arm 30 to mounting ears 22. Linkage arm 30 is in turn pivotally secured to hydraulic cylinder 14 by a pin 32. An extension arm 34 is pivotally secured on one end to pin 32 and on its other end is pivotally secured by a pin 36 to boom 12.

Rotational mounting 20 includes a hydraulic motor 38 adjacent one of the mounting ears 22 and is secured to the exterior of turntable plate 24. Plate 24 includes a motor protection shield 40 integral therewith and extending upwardly therefrom around motor 38. Motor 38 has a shaft 42 extending downwardly through turntable plate 24. A pinion gear 44 is secured to the end of shaft 42 and the gear teeth thereof are engaged with the gear teeth of a ring gear 46.

Ring rear 46 is supported by bearings, not shown, between it and turntable bearing plate 24. Ring gear 46 is secured to the upper end portion 47 of a frame 48. A rotary hydraulic swivel 50 is rotatively secured to plate 24 centrally of ring gear 46. Swivel 50 is connected to the hydraulic system of the excavator by hydraulic supply hoses 52. Various rotational mountings are well known in the art, and an example of such is seen in U.S. Pat. No. 4,017,114 issued Apr. 12, 1977 to LaBounty, which patent is incorporated herein by reference.

Figure 2:
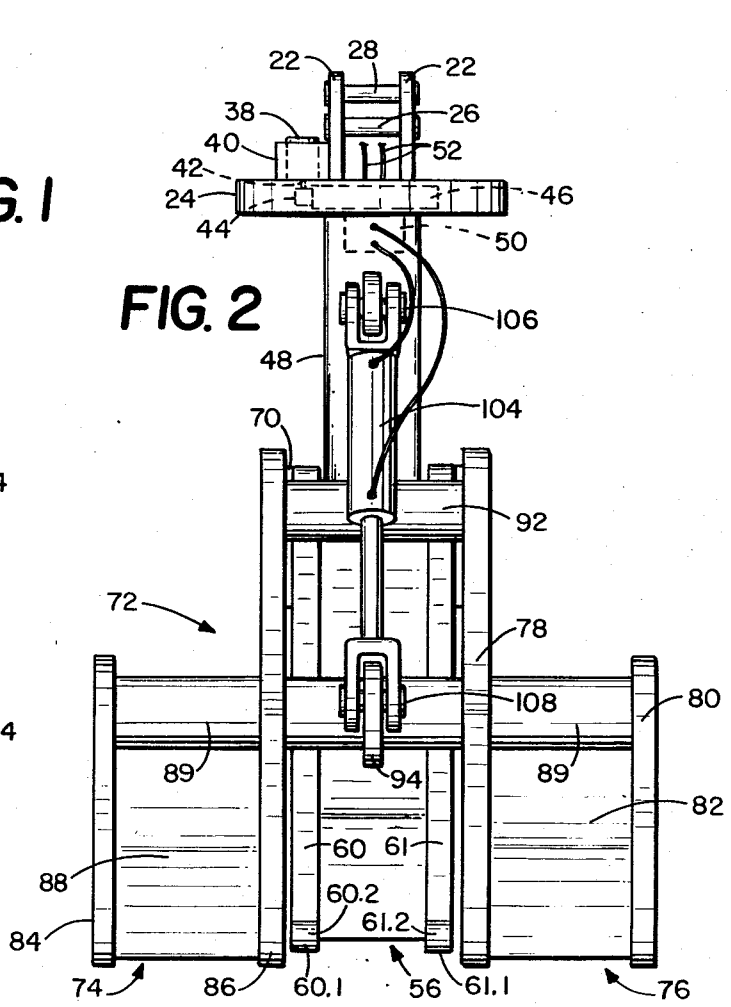
FIG. 2 shows an enlarged side elevation view of the rail grapple.

Frame 48 includes a pair of rigid mounting ears 54 and 55 integral therewith and extending therefrom in opposite directions. A front jaw and tine 56 is pivotally secured to frame 48 by a mounting pin 57 extending through a tubular shaft 58. Shaft 58 is integral with the bottom end of frame 48. Front tine 56 is arcuate in shape and includes, as seen in FIG. 2, an inner plate 60 and an outer plate 61. Plates 60 and 61 lie adjacent and parallel to each other, and define an inner concave surface 56.1, and an outer convex surface 56.2 of tine 56. Plates 60 and 61 terminate with tip ends 60.1 and 61.1. Ends 60.1 and 61.1 include knob portions 60.2 and 61.2 integral therewith and extending therefrom in a direction outwardly from concave surface 56.1. Plates 60 and 61 are secured together by rigid spacing members 62 and 63, and a tubular shaft 64 extending therebetween. Spacing members 62 and 63 are also attached to shaft 64, and member 62 is angled to conform to the curve of tine 56. Shaft 64 includes a rigid mounting ear 66 integral therewith and extending outwardly therefrom away from convex surface 56.2. Tine plate 60 includes a gear plate 70 lying parallel to and integral therewith on an exterior surface thereof. Gear plate 70 includes a plurality or gear teeth 71 integral therewith and extending radially therefrom.

Grapple 10 also includes a back jaw 72. As seen in FIG. 2, back tine 72 includes an inner portion or tine 74 and an outer portion or tine 76 which is spaced from the inner portion or tine 74 to receive to front jaw tine 56 therebetween in interleaving relation. Outer portion 76 includes two tine plates 78 and 80 lying adjacent and parallel to each other and interconnected by a rigid spacing member 82. Tine portion 4 includes tine plates 84 and 86 lying adjacent and parallel to each other and interconnected by a rigid spacing member 88. Plates 78, 80, 84 and 86 are secured to a tubular shaft 89 extending therebetween. Plates 78, 80, 84 and 86 define an inner concave surface 72.1 and an outer convex surface 72.2 of jaw 72, and include tip ends 87. Plates 78 and 86 provide for pivotal atachment of jaw 72 to frame 48 by securement to a pivot pin 90 extending therebetween through a shaft 92, shaft 92 being integral with frame 48. Shaft 92 includes a rigid mounting ear 94 integral therewith and extending outwardly therefrom away from convex surface 72.2.

Plate 86 includes gear teeth 95 integral therewith and extending radially therefrom from the end thereof pivotally mounted to frame 48. Teeth 95 are enmeshed with teeth 71 of gear plate 70 of front tine 56. The gear means, comprising mashed gears 71 and 95, require swinging of both jaws when either of them is moved.

A hydraulic cylinder 96 is pivotally secured on one end to mounting ear 54 by a pivot pin 98 extending through an aperture therein, and on its opposite end pivotally secured to mounting ear 66 by a pivot pin 100 extending through an aperture therein. Hydraulic cylinder 96 includes hydraulic lines 102 for connection to the hydraulic system of the excavator through connection with rotary hydraulic swivel 50.

Similarly, a hydraulic cylinder 104 is pivotally secured on one end to mounting ear 55 by a pivot pin 106 extending through an aperture therein. Hydraulic cylinder 104 is pivotally secured on its opposite end to mounting ear 94 by a mounting pin 108 extending through an aperture therein. Cylinder 104 includes hydraulic lines 110 for connection to the hydraulic system of the excavator through connection with rotary hydraulic swivel 50. Cylinders 96 and 104 form drive means for the jaws 72 and 56.

The operation of rotary mounting 20 can be appreciated wherein operation of hydraulic motor 38, through shaft 42 and pinion gear 44, drives ring gear 46. As ring gear 46 is integral with frame 48, rotary mounting 20 provides for rotation of tines 56 and 72 through an arc of 360° about the central axis of rotation of ring gear 46.

Front tine 56 and back jaw 72 are operated by hydraulic cylinders 96 and 104, respectively. Gear teeth 95 and 71 are enmeshed so that tines 56 and 72 operate coincidentally. The gear teeth thereby provide means for operating front tine 56 and back tine 72 in an equivalent manner and provide means, in cooperation with cylinders 96 and 104, for preventing either of the tines from swinging freely.

Figure 3:
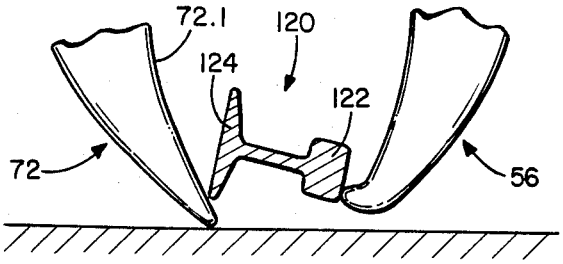
FIG. 3 shows an enlarged detail elevation view of the tines and their manner of cooperation to initially pick up a railroad rail lying upon its side.
Figure 4:
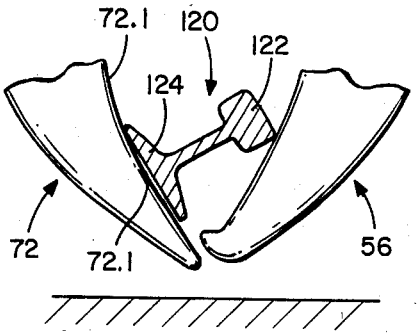
FIG. 4 shows an enlarged detail elevation view of the ends of tines with the railroad rail held therebetween.
Figure 5:
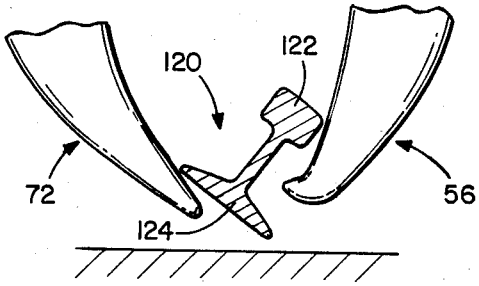
FIG. 5 shows an enlarged detail view of the ends of the tines as they cooperate to orient a railroad rail into an upright position.
Figure 6:
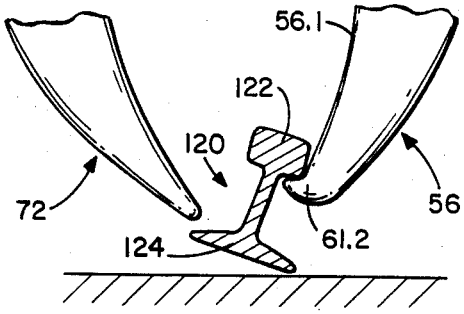
FIG. 6 shows an enlarged detailed view of the ends of the tines as they cooperate with a railroad rail to place it in an upright position upon the ground, and in particular showing the manner of cooperation of the ball of the rail with the knob of the front tine.
Figure 7:
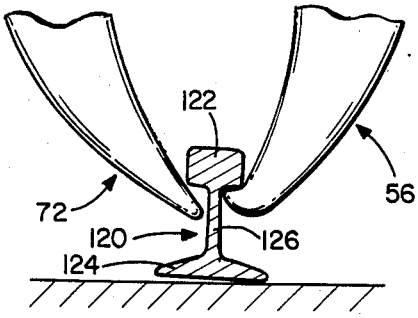
FIG. 7 shows an enlarged detailed elevation view of the ends of the tines as they are used to pick up a railroad rail along the web portion thereof.

The manner in which tines 56 and 72 cooperate to pick up and orient a railroad rail can be understood by now referring to FIGS. 3 through 7. As seen in FIG. 3, a railroad rail, generally designated 120, is seen lying upon its side with the ball end 122 thereof confronting the knob portion of front tine 56, and with the flange end 124 thereof adjacent and confronting the inner concave surface 72.1 of back tine 72. As seen in FIG. 4, if tines 72 and 56 are caused to close together, by operation of cylinders 96 and 104, rail 120 will be caused to slide up between tines 56 and 72 wherein the flat end surface of flange 124 will lie substantially parallel to that portion of concave surface 72.1 of tine 72 with which it is in contact. As seen in FIG. 5, subsequent gradual opening of tines 56 and 72 will result in a portion of flange 124 extending therebetween as the tip ends thereof separate. As seen in FIG. 6, ball end 122 is held by the knob portion thereof so that rail 120 is supported thereby. As a result thereof, rail 120 is prevented from sliding along concave inner surface 56.1 of front tine 56 and falling to the ground onto its side. Thus, as seen in FIG. 6, front tine 56 can be used to hold rail 120 by ball end 122 and thus urge rail 120 into the upright position with the bottom surface of flange 124 on the ground. As seen in FIG. 7, rail 120 can then be grasped along web portion 126 thereof with ball end 122 held between front tine 56 and back tine 72. It can be appreciated that inner portion 74 and outer portion 76 of back tine 72 provide for contacting of the rail at separate points therealong by tip ends 87, thus in cooperation with front tine 56, providing for a secure holding of rail 120.

Rotary mounting 20 provides for a convenient means for orienting the tines so that front tine 56 will confront the ball end 122 of rail 120 regardless of the position on the ground in which rail 120 is lying. However, rail grapple 10 of the present invention can be used without a rotary mounting, whereby if the rail is lying upon the ground such that ball end 122 is adjacent back tine 72, then by suitable closing of front tine 56 and rear tine 72, flange 124 will be caused to slide along concave inner surface 56.1 of front tine 56. If front tine 56 and rear tine 72 are caused to close sufficiently, rail 120 will then rotate within the grasp of tines 56 and 72 about an axis parallel with the longitudinal extension of the rail, such that flange end 124 will come into contact with the inner concave surface 72.1 of back tine 72. If front tine 56 and rear tine 72 are then caused to separate, rail 120 will have been rotated through an arc of approxiately 180° such that upon opening of front tine 56 and rear tine 72, rail 120 can be placed upon the ground such that the position of ball end 122 and flange 124 will have been reversed, i.e., rail 120 will now be positioned upon the ground such that front tine 56 and flange 124 will be adjacent back tine 72. Rail grapple 10 can thus be operated, as previously described, to orient rail 120 into an upright position upon the ground.

What is claimed is:

1. A rail orienting grapple attachable to the boom structure of a hydraulic excavator, comprising:

a frame having attachment means releasably securable to the boom structrue of the excavator, first and second jaws suspended from the frame in confronting relation with each other, one of said jaws being swingable and having a pivotal connection with the frame to accommodate swinging of the jaw toward and away from the other jaw, said jaws having cooperating tines with depending tip ends and with arcutely shaped concave inner sides generally confronting each other, the tine of the first jaw having a knob on the tip end thereof and projecting transversely from the tip end and toward the tine of the second jaw, and the second jaw having a smooth concave inner surface, and drive means for swinging said one swingable jaw toward and away from the other jaw.

2. The rail orienting grapple as defined in claim 1, wherein one of the jaws including a pair of tines spaced from each other and receiving the tine of the other jaw therebetween in interleaving relation.

3. The rail orienting grapple as defined in claim 1, wherein the drive means includes a first hydraulic cylinder pivotally secured on one end to the first jaw and on its other end to the frame.

4. The rail orienting grapple as defined in claim 1 wherein both jaws have pivotal connections with the frame, a pair of meshed gear means each connected with a respective jaw and requiring swinging of both jaws in response to operation of said drive means.

5. The rail orienting grapple as defined in claim 1 wherein, the frame includes a rotary mounting for providing rotation thereof about a central axis of the frame.

* * * * *

UNITED STATES PATENT AND TRADEMARK OFFICE

CERTIFICATE OF CORRECTION

PATENT NO. : 4,703,968

DATED : November 3, 1987

INVENTOR(S) : Roy E. LaBounty

It is certified that error appears in the above-identified patent and that said Letters Patent is hereby corrected as shown below:

Column 4, line 26, delete the second "to" and insert --the--.

Column 4, line 30, delete "4" and insert --74--.

Signed and Sealed this

Thirtieth Day of August, 1988

*Attest:*

DONALD J. QUIGG

*Attesting Officer*

*Commissioner of Patents and Trademarks*